US007732699B2

(12) United States Patent
Ju

(10) Patent No.: US 7,732,699 B2
(45) Date of Patent: Jun. 8, 2010

(54) CENTRAL PROCESSING UNIT FOR SINGING ROOM MACHINERY AND MP3

(76) Inventor: Sam Young Ju, 2-67, Sungui-dong, Nam-gu, Incheon 402-812 (KR)

( * ) Notice: Subject to any disclaimer, the term of this patent is extended or adjusted under 35 U.S.C. 154(b) by 128 days.

(21) Appl. No.: 11/574,837

(22) PCT Filed: Sep. 13, 2005

(86) PCT No.: PCT/KR2005/003013

§ 371 (c)(1),
(2), (4) Date: Mar. 7, 2007

(87) PCT Pub. No.: WO2006/031045

PCT Pub. Date: Mar. 23, 2006

(65) Prior Publication Data

US 2008/0202319 A1 Aug. 28, 2008

(30) Foreign Application Priority Data

Sep. 16, 2004 (KR) ..... 10-2004-0074207

(51) Int. Cl.
*G10H 1/36* (2006.01)

(52) U.S. Cl. ..... 84/610; 84/609; 84/634; 84/649; 84/650; 84/666; 84/477 R

(58) Field of Classification Search ..... None
See application file for complete search history.

(56) References Cited

U.S. PATENT DOCUMENTS 7,164,076 B2 * 1/2007 McHale et al. ..... 84/616
2002/0066097 A1 * 5/2002 Hattori et al. ..... 725/34
2005/0252362 A1 * 11/2005 McHale et al. ..... 84/616
2005/0255914 A1 * 11/2005 McHale et al. ..... 463/31
2006/0009979 A1 * 1/2006 McHale et al. ..... 704/270

(Continued)

FOREIGN PATENT DOCUMENTS

JP 2000-338984 A 12/2000

(Continued)

*Primary Examiner*—Marlon T Fletcher
(74) *Attorney, Agent, or Firm*—John K. Park; Park Law Firm

(57) ABSTRACT

A central processing unit (CPU) for an MP3 player and a karaoke system makes it possible to reduce the size of the MP3 and the karaoke system by integrally building various kinds of storage units in a DSP and an RISC processor for executing control commands and generating control signals. The CPU 100 includes a display device 160; a microphone 140; a loudspeaker 170; a data storage unit 130 for storing real-time recorded data inputted through the microphone and wave sample data for synthesizing sounds of musical instruments, and also storing a background image, a caption, and font data, which are visually and aurally provided to the user; a main storage unit 120 for sharing the sample data of the data storage unit 130; an RISC processor 102 for storing sound sources, which output information corresponding to sound pitches and volumes of musical instruments, in the form of a MIDI file; a DSP 101 for synthesizing the data outputted from the main storage unit and the RISC processor to provide the music desired by the user; a codec HO for converting an output of the DSP; and an USB input/output terminal 103 for connecting the CPU to external devices.

2 Claims, 3 Drawing Sheets

U.S. PATENT DOCUMENTS

2008/0202319 A1* 8/2008 Ju ..... 84/602

FOREIGN PATENT DOCUMENTS

JP 2001-343982 A 12/2001
KR 10-0238312 B1 10/1999
KR 10-2001-0077457 A 8/2001
KR 10-2001-0079150 A 8/2001
KR 10-2001-0107372 A 12/2001
KR 10-2004-0024432 A 3/2004

* cited by examiner

[Fig. 1]
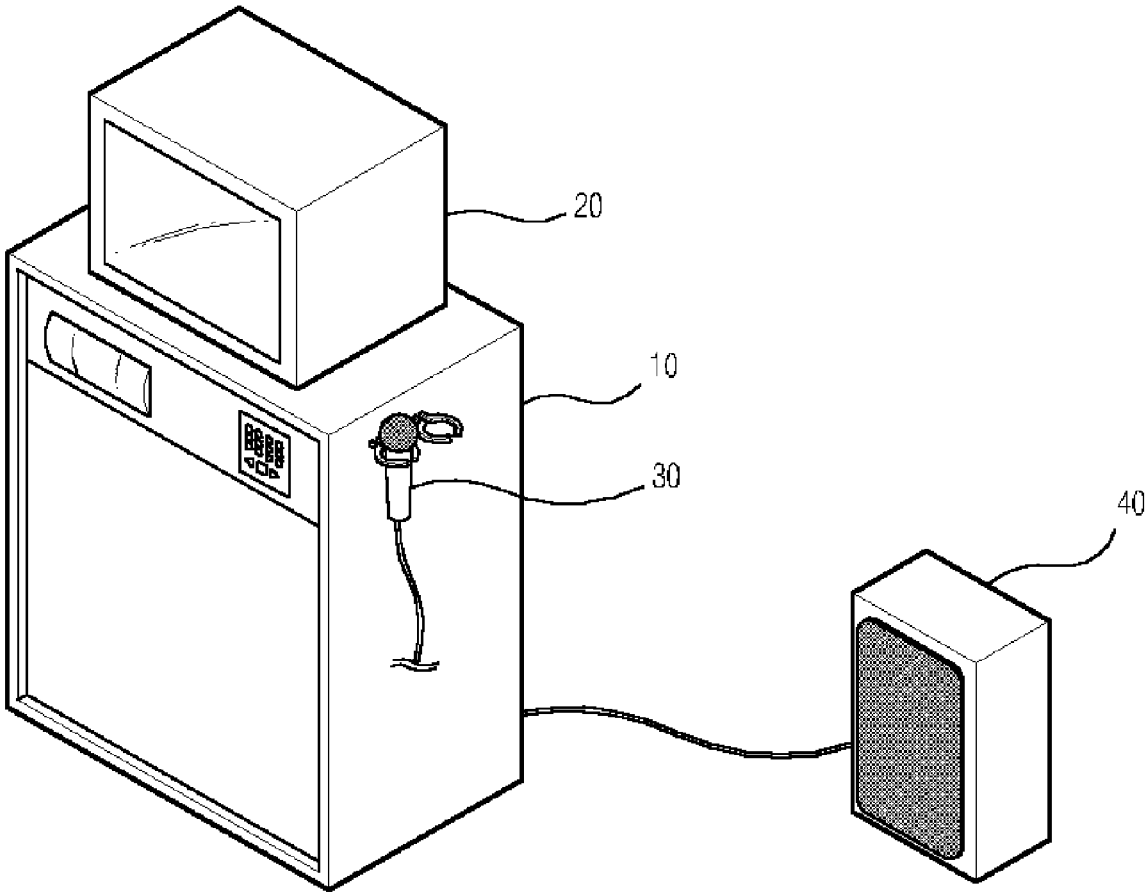

[Fig. 2]
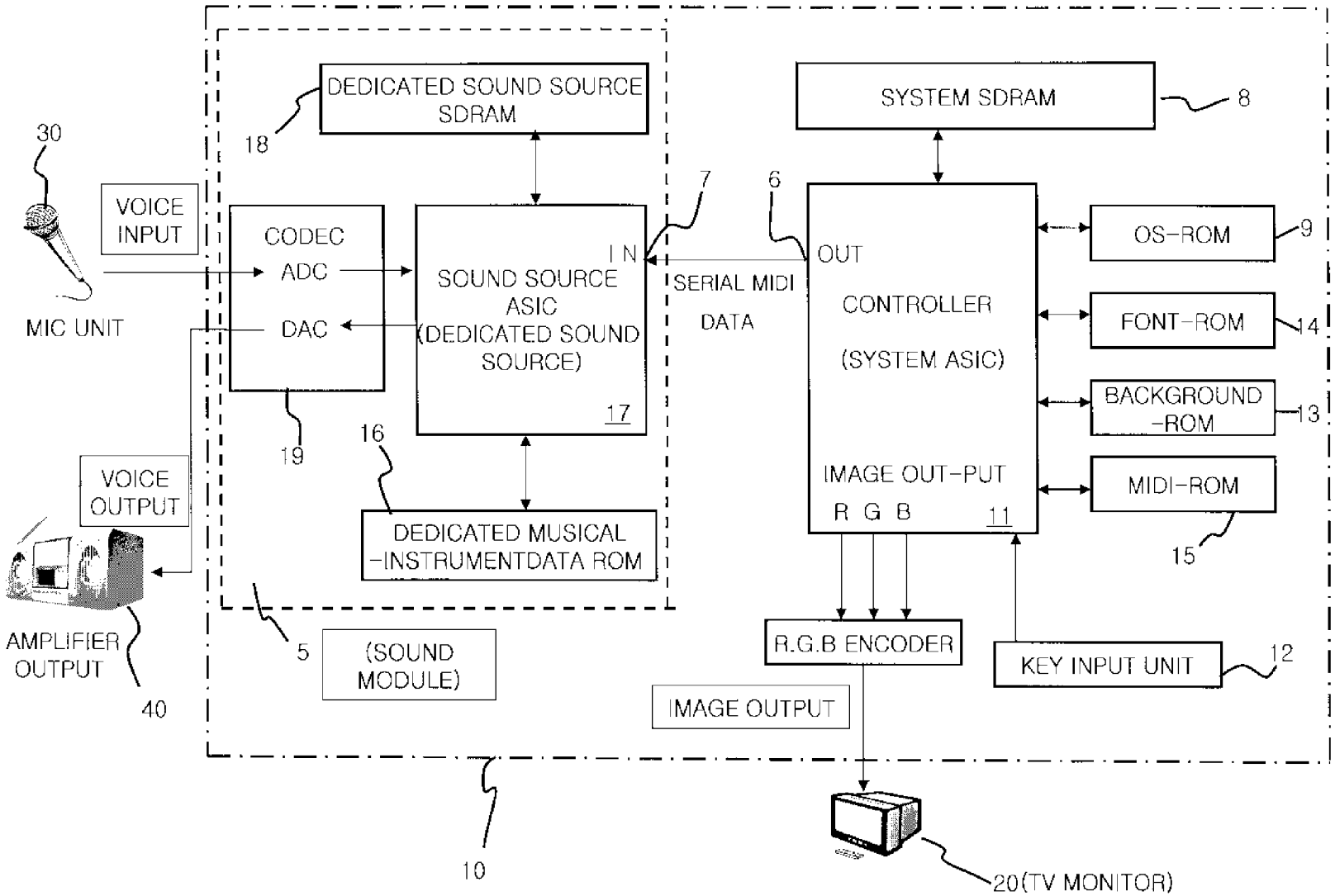

[Fig. 3]
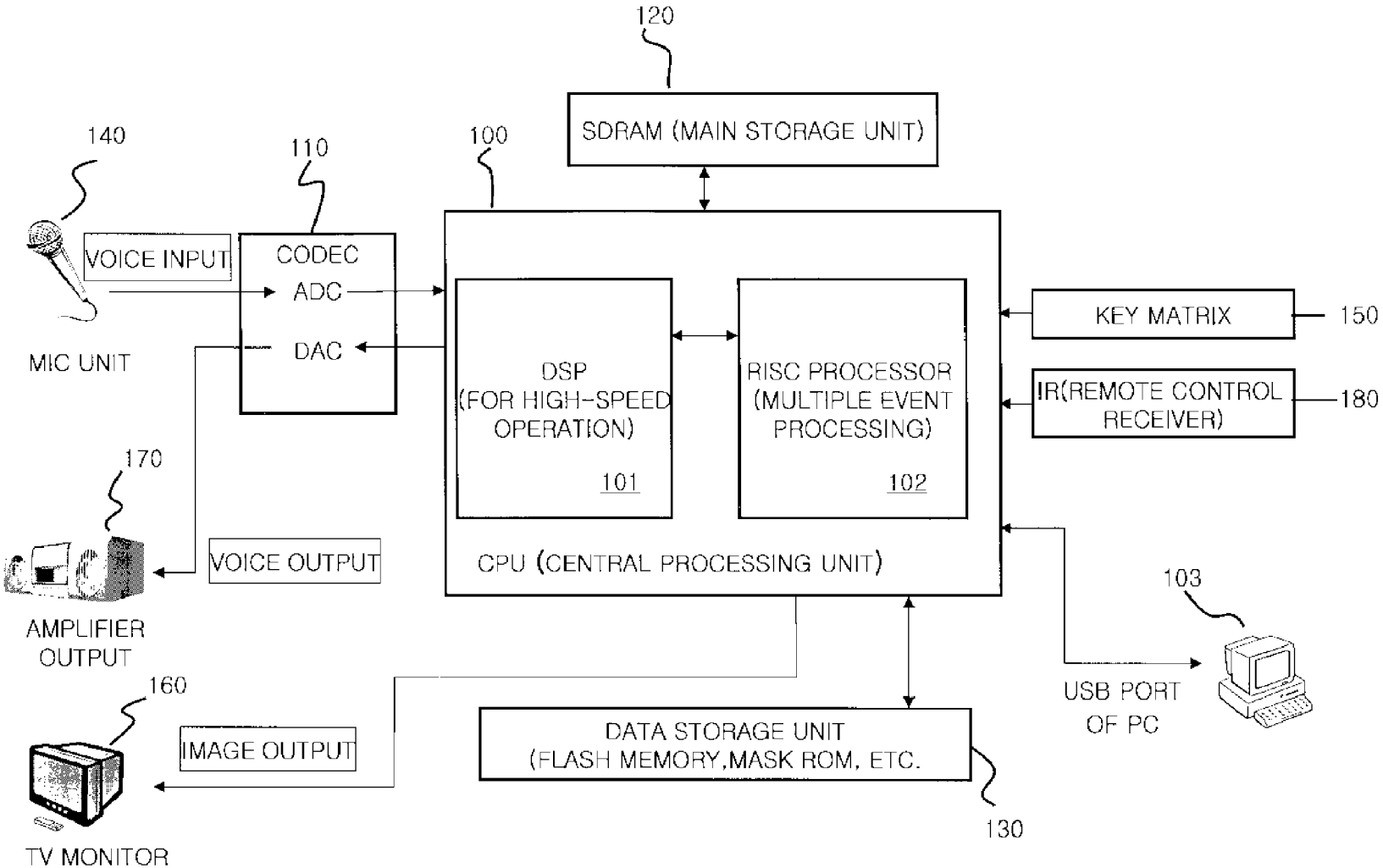

CENTRAL PROCESSING UNIT FOR SINGING ROOM MACHINERY AND MP3

TECHNICAL FIELD

The present invention relates to a central processing unit (CPU) for a singing room machinery (i.e., karaoke system) and an MP3, and more particularly to a CPU for a karaoke system and an MP3 player that makes it possible to reduce the size of the MP3 and the karaoke system and to make the MP3 player and the karaoke system compact and portable by integrally building various kinds of storage units in a DSP and an RISC processor for executing control commands and generating control signals.

BACKGROUND ART

MP3 players and singing room machinery (i.e., karaoke systems), which are kinds of entertainment machines, can provide accompaniment and words of songs requested by users without limitations in time and space. The use of these MP3 players and karaoke systems has been abruptly increased.

In a sound module 5 for a conventional MP3 player or a karaoke system, serial MIDI data 6 is outputted from a control unit 11 of a main system and then is provided to an internal serial input terminal 7 of a dedicated sound ASIC 17. In order to decompress the data in the dedicated sound ASIC 17 and a musical-instrument data ROM 16, however, a separate SDRAM 18 should be used, so that the cost of the MP3 player and the karaoke system is increased and the musical-instrument data stored in the ROM 16 cannot be upgraded.

The karaoke system as shown in FIG. 1 briefly includes a main device 10 for inputting/outputting control commands and data, a display device 20, electrically connected to the main device 10, for displaying image information and words information, a microphone 30 for receiving a user's voice and a loudspeaker 40 for outputting the voice inputted through the microphone 30 and music provided from the main device 10.

As shown in FIG. 2, the main device 10 has a controller 11 for processing various kinds of control commands. The controller 11 is provided with an input/output terminal unit for electrically connecting to external devices (e.g., microphone, loudspeaker, display device, and others). Also, the controller 11 is connected to a manipulation unit 12 for inputting the various kinds of control commands to the controller 11.

The controller 11 is connected to an image storage unit 13 for storing images to be outputted to the display device 20, and a words storage unit 14 for storing words to be outputted to the display device 20. The dedicated sound ASIC 17 that stores music to be outputted through the loudspeaker 40 is connected to an SDRAM 18 and a codec 19 so as to decompress the musical-instrument data stored in the ROM 16.

If a user selects the number of his/her desired song through the manipulation unit 12 in a state that the main device 10 is connected to the microphone 30, the display device 20, and the loudspeaker 40 through the input/output terminal unit provided therein, information stored in the image storage unit 13, the words storage unit 14, and the music storage unit 15 is outputted through the display device 20 and the loudspeaker 40.

In this case, the user's voice is inputted to the microphone 30, and then is outputted through the loudspeaker 40, so that the user can listen to the music and the voice outputted through the loudspeaker 40.

However, the main device 10 for the karaoke system as described above should be additionally provided with the image storage unit 13, the words storage unit 14, and the music storage unit 15, and the controller 11 should include a ROM 9 for a system OS and an SDRAM 8 for the system. In addition, it is not possible to upgrade the image storage unit 13 and the music storage unit 15, and the size of the main device 10 is increased due to the electric connection of the image storage unit 13 and the music storage unit 15 to the controller 11.

As the size of the main device 10 is increased, it is inconvenient for a user to handle, carry, and install the karaoke system.

In particular, since music corresponding to respective songs (i.e., music performed by various musical instruments) is typically stored in the music storage unit 15, the size of the music storage unit 15 is increased, and a large-capacity music storage unit 15 is required in order to store a large number of tunes.

DISCLOSURE OF INVENTION

Technical Problem

Therefore, the present invention has been made to solve the above-mentioned problems occurring in the prior art, and an object of the present invention is to provide a central processing unit (CPU) for an MP3 player and a karaoke system that can output an accompaniment of a song desired by a user, background image, caption and MP3 music by synthesizing in real time an MIDI file, the background image, the caption and font data stored in auxiliary storage devices using a DSP and an RISC processor built in the CPU.

Another object of the present invention is to provide a CPU for an MP3 player and a karaoke system that can make it possible to reduce the size of the MP3 and the karaoke system and to make the MP3 player and the karaoke system compact and portable.

Additional advantages, objects, and features of the invention will be set forth in part in the description which follows and in part will become apparent to those having ordinary skill in the art upon examination of the following or may be learned from practice of the invention

Technical Solution

In order to accomplish the above-mentioned objects, there is provided a central processing unit (CPU) for an MP3 player or a karaoke system that includes the CPU for inputting and outputting control commands and data, a display device, electrically connected to the CPU, for displaying image information and words information, a microphone for receiving a voice of a user, and a loudspeaker for outputting the voice inputted through the microphone and music provided from the CPU, according to the present invention, which comprises a data storage unit for storing real-time recorded data inputted through the microphone and wave sample data for synthesizing sounds of musical instruments, and also storing a background image, a caption, and font data, which are visually and aurally provided to the user; a main storage unit for sharing the sample data of the data storage unit; an RISC processor for storing sound sources, which output information corresponding to sound pitches and volumes of musical instruments, in the form of a MIDI file so as to output music corresponding to the data transmitted from the main storage unit; a DSP for synthesizing the data outputted from the main storage unit and the RISC processor to provide the music desired by the user; a codec for converting an output of the DSP; and an USB input/output terminal for connecting the CPU to external devices.

ADVANTAGEOUS EFFECTS

The CPU for the MP3 player or karaoke system as constructed above according to the present invention can output music desired by a user by operating sample data stored in the form of a MIDI file through the DSP and the RISC processor, and thus the storage space of the CPU can be minimized.

Also, since the CPU is provided with the microphone for inputting user's voice in a body, as well as it stores and processes various kinds of data, the MP3 player or karaoke system can be manufactured with a compact size to facilitate the user's handling and carrying of the karaoke system

BRIEF DESCRIPTION OF THE DRAWINGS

The above objects, other features and advantages of the present invention will become more apparent by describing the preferred embodiments thereof with reference to the accompanying drawings, in which:

FIG. 1 is a schematic view illustrating a conventional karaoke system;

FIG. 2 is a block diagram illustrating the construction of a CPU for a conventional karaoke system; and FIG. 3 is a block diagram illustrating the construction of a CPU for an MP3 player and a karaoke system according to the present invention.

DESCRIPTION OF MAIN PARTS IN THE DRAWINGS

100: central processing unit, 101: DSP
102: RISC processor, 103: USB input/output terminal
110: codec (ADC/DAC), 120: main storage unit (SDRAM)
130: data storage unit (flash ROM), 140: microphone
150: key input unit, 160: display device (TV monitor)
170: speaker, 180: IR remote control receiver

BEST MODE FOR CARRYING OUT THE INVENTION

Now, a CPU for an MP3 player and a karaoke system according to a preferred embodiment of the present invention will be described in detail with reference to the accompanying drawings. In the following description of the present invention, the same drawing reference numerals are used for the same elements even in different drawings, and the duplicate explanation thereof will be omitted.

MODE FOR THE INVENTION

FIG. 3 is a block diagram illustrating the construction of a CPU for an MP3 player and a karaoke system according to the present invention.

Referring to FIG. 3, the present invention provides a CPU 100 for a karaoke system capable of simultaneously outputting music desired by a user and a user's voice. The CPU includes a data storage unit 130 for storing mass data such as real-time recorded data inputted from a microphone 140, wave sample data for synthesizing sounds of musical instruments, and a background image, a caption, and font data, which are visually and aurally provided to a user.

The CPU 100 is provided with an RISC processor 102 for storing sound sources, which output information corresponding to sound pitches and volumes of musical instruments, in the form of a MIDI file so as to output music corresponding to data transferred from a main storage unit 120 which shares sample data of the data storage unit 130, and a DSP 101 for synthesizing data outputted from the main storage unit 120 and the RISC processor 102 and processing the music desired by the user.

The DSP 101 is connected to a codec 110 for converting the output data, and has USB ports for transmitting/receiving data to/from a personal computer which is connected to USB input/output terminals 103 for connecting the DSP to external devices.

Preferably, the CPU 100 is provided with a microphone 140 for inputting a user's voice, a key input unit 150 for inputting various kinds of control commands and an IR remote control receiver 180 in a body, for easy carrying and keeping.

The operation of the present invention configured as described above will now be described in detail.

The RISC processor 102 stores and corrects various kinds of data as well as it starts and manages the system. Also, the RISC processor 102 performs a multiple operation such as key input process, image arrangement process, and major event process (including management of reporting devices).

The DSP 101 performs a high-speed operation such as reproduction and synthesis of timbres of musical instruments, effect processing of background images, and decompression of mass data.

The data storage unit 130 stores font data, background images, data for synthesizing timbres of musical instruments, MP3 data, recorded data, and others. The RISC processor 102 and the DSP 101 share the various kinds of data stored in the main storage unit 120.

Also, the data storage unit 130 stores sample data in the form of a wave created on the basis of timbres of actual musical instruments to reproduce and synthesize the timbres of the musical instruments.

After starting and initializing the system, the sample data stored in the data storage unit 130 is transferred to the main storage unit 120 so that the RISC processor 102 and the DSP 101 can share the sample data. When the music starts to play, the DSP 101 performs a sample-rate conversion and an amplitude conversion of the necessary sample data stored in the main storage unit 120 on the basis of key (i.e., pitch of sound) information and the volume (i.e., stress of sound) information received from the RISC processor 102 in real time.

The frequency modulation and sample-rate conversion of the sample data are necessary in order to express all musical scales and diverse stresses of the sound by using minor sample data of the respective musical instruments. In addition, in order to reduce overhead happening due to mathematical operation needed for the conversion, a trigonometric function and an exponential operation are computed using a look-up table.

Since the effect processing of the background image and the decompression of the mass data are performed in real time, simultaneously with the synthesis of the timbres of the musical instruments in the DSP 101, the priority of the respective processing and operation is determined and managed in consideration of the load of the RISC processor 102.

At the same time, the voice inputted through the microphone 140 is converted into quantized data by an analog-to-digital converter (ADC) of the codec 110, and is then inputted to a serial port of the DSP 101. The quantized data is echoed using a buffer of an internal memory of the DSP 101.

The synthesized data of the musical instruments and the echoed data are added together and then outputted through the serial port of the DSP 101 in the form of a digital audio signal.

The output digital audio signal is converted into an analog signal by the DAC of the codec 110 to be transmitted to the last output terminal.

The operation related to the synthesis and reproduction of the timbres of the musical instruments is performed by the DSP 101. Also, the operation related to the echo processing of the voice signal inputted from the microphone 140 and the reproduction of the MP3 data are also performed by the DSP 101.

That is, since all voice signals reproduced by the system are processed (e.g., synthesized) by the DSP 101, the reproduced audio signal being finally outputted can be recorded by the DSP 101 without the necessity of a separate recording device. This recorded data is stored in the data storage unit 130 after it is compressed by the DSP 101.

Through the USB ports of the input/output terminal 103, an operating system (OS) (i.e., firmware) for driving the system can be upgraded, and the data can be inputted to or outputted from the personal computer.

In the case of upgrading the OS, MP3 file, MIDI file, background image file, caption file, and font data, a new OS file is transmitted to the data storage unit 130, the system is disconnected from the personal computer, and then the power is applied to the system. Accordingly, the system is initialized after starting, and the new OS stored in the data storage unit 130 is transmitted to the main storage unit 120, so that the system operates with the new OS.

INDUSTRIAL APPLICABILITY

As apparent from the above description, the CPU for the MP3 player or karaoke system according to the present invention can output music desired by a user by operating sample data stored in the form of a MIDI file through the DSP and the RISC processor, and thus the storage space of the CPU can be minimized.

Also, since the CPU is provided with the microphone for inputting user's voice in a body, as well as it stores and processes various kinds of data, the MP3 player or karaoke system can be manufactured with a compact size to facilitate the user's handling and carrying of the karaoke system.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

The invention claimed is:

1. A Central Processing Unit (CPU) for a karaoke system, wherein the CPU is configured to:

receive realtime voice data input through a microphone;

process information corresponding to sound pitches and volumes of musical instruments in Musical Instrument Digital Interface (MIDI) file form by receiving wave sample data used to synthesize sounds of musical instruments so that the corresponding music can be output;

process the sample data by performing sample rate conversion and amplitude conversion on the sample data, and synthesizes the processed data and the realtime voice data input through the microphone into the voice signals, so that the voice signals can be codec-processed and output to a speaker; and process video signals by receiving data including background images, captions and font data to output to a display device;

wherein the CPU comprises a DSP and a RISC processor.

2. The CPU for a karaoke system as claimed in claim 1, wherein the CPU can transmit and receive data to or from a computer through a USS input and output terminal 103, thereby upgrading an Operating System (OS; firmware) used for controlling the system.

* * * * *